United States Patent [19]

Krier et al.

[11] 3,942,218

[45] Mar. 9, 1976

[54] SCRUBBING MACHINE

[75] Inventors: Keith N. Krier; Neil F. Brown; Steven J. A. Waldhauser, all of Minneapolis, Minn.

[73] Assignee: Tennant Company, Minneapolis, Minn.

[22] Filed: June 19, 1974

[21] Appl. No.: 480,973

Related U.S. Application Data

[62] Division of Ser. No. 255,612, May 22, 1972, Pat. No. 3,824,645.

[52] U.S. Cl. ..... 15/340; 15/50 C; 15/50 R

[51] Int. Cl.[2] ..... A47L 11/29

[58] Field of Search ..... 15/340, 49 C, 50 C, 50 R, 15/78, 82, 83, 349, 353

[56] References Cited

UNITED STATES PATENTS

| | | | |
|---|---|---|---|
| 1,463,707 | 7/1923 | Koger | 15/340 X |
| 1,878,508 | 9/1932 | Menkhaus | 15/50 R |
| 3,702,488 | 11/1972 | Kasper | 15/50 C |

*Primary Examiner*—Richard E. Aegerter
*Assistant Examiner*—Larry Jones
*Attorney, Agent, or Firm*—Dugger, Johnson & Westman

[57] ABSTRACT

A scrubbing machine that includes an articulated vehicle having a power unit and a trailer unit coupled thereto, said trailer unit having cleaning and dirty solution tanks thereon, a squeegee assembly on the power unit having a central liquid take-up tube and a second take-up tube at one end portion thereof, controls operated by turning the vehicle in the appropriate direction for switching the application of vacuum from the central tube to the second tube, a scrubber head unit and an assembly for mounting and carrying the scrubber unit on the vehicle and raising and lowering the scrubber unit including an articulated joint to permit limited pivotal movement of the scrubber head about a generally vertical axis and an axis perpendicular thereto.

13 Claims, 11 Drawing Figures

SCRUBBING MACHINE

CROSS-REFERENCE TO RELATED APPLICATIONS

This application is a divisional application of our application, Ser. No. 255,612, filed May 22, 1972, now U.S. Pat. No. 3,824,645.

BACKGROUND OF THE INVENTION

The present invention relates to self-propelled power driven scrubbing machines.

In co-pending application Ser. No. 72,275, filed Sept. 15, 1970, now U.S. Pat. No. 3,702,488, there is disclosed a scrubbing machine that includes a mobile vehicle which mounts a scrubber head unit. In order to provide a vehicle of even greater maneuverability, better liquid pick up when turning in one direction and other advantages, this invention has been made.

SUMMARY OF THE INVENTION

The present invention relates to a self-propelled scrubbing machine that includes an articulated vehicle. The vehicle has a power unit and a trailer unit, a scrubber unit being mounted on the power unit by an articulated joint. A squeegee assembly is mounted on the power unit and liquid collection devices cooperate with said assembly to remove liquid from the surface being cleaned at selected spaced locations relative the assembly, depending on whether the vehicle is being turned or is traveling straight ahead.

One of the objects of this invention is to provide a new and novel articulated vehicle for maintaining surfaces such as floors. With reference to the above object, it is another object to provide a squeegee assembly on the vehicle and liquid collection devices adjacent the central and a transverse end portion of the squeegee that are selectively controlled by the turning of the vehicle to pick up liquid from adjacent the central portion and alternately adjacent the end portion.

An additional object of this invention is to provide a new and novel manner of mounting, a unit having a rotary surface maintenance tool thereon, on a vehicle for pivotal movement about axes that are at right angles to one another. In furtherance of the last mentioned object, it is another object of this invention to mount said unit on the vehicle for movement between a normal surface maintenance position and an elevated position.

Another object of this invention is to provide in a scrubbing unit having a rotary brush and a debris hopper for collecting liquid raised by said brush, new and novel deflectors for directing liquid raised by the brush into the hopper. In furtherance of the last mentioned object, it is another object of this invention to provide new and novel structure for selectively withdrawing liquid from the hopper and alternately permitting liquid in the hopper being recycled to the surface.

A still further object of this invention is to provide on a vehicle that mounts a surface maintenance unit having a transverse rotary scrubbing brush, new and novel structure for selectively retaining said unit in a position on the vehicle for windrowing liquid on the surface over which the vehicle moves and alternatingly retaining the brush substantially perpendicular to the direction of movement of said unit.

Figure 1:
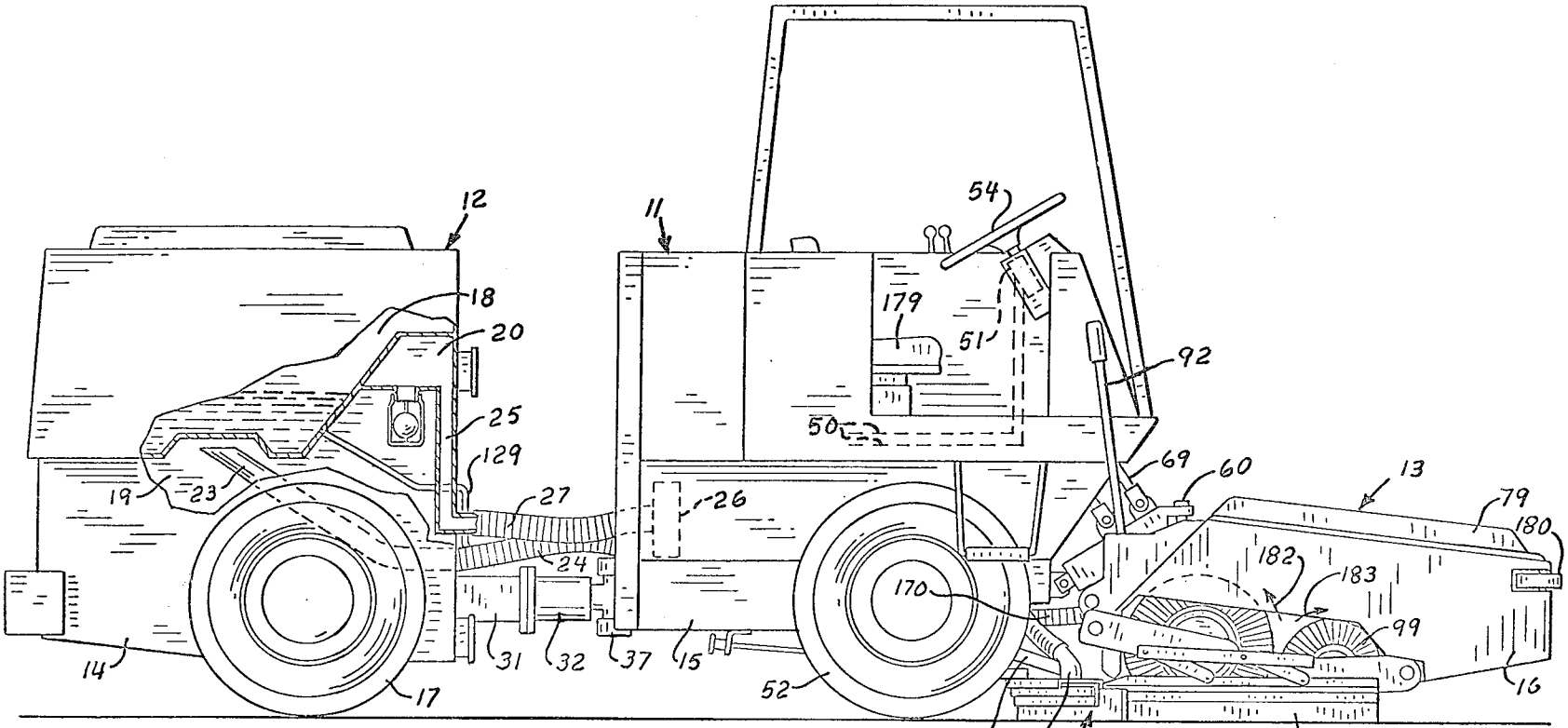
FIG. 1 is a right side view of the apparatus of this invention.

Referring now in particular to FIG. 1, the apparatus of this invention includes a scrubber head unit, generally designated 13 that is mounted on an articulated vehicle having a power unit, generally designated 11, and a trailer unit generally designated 12. The scrubber head unit, power unit and trailer unit have main frames 16, 15, and 14 respectively, the trailer unit frame mounting a pair of ground engaging wheels 17 with one on either side thereof. Also the trailer unit frame includes a top clean water or cleaning solution tank 18, a bottom dirty scrubbing solution tank 19, and a plenum chamber member 20 opening to the top of tank 19 for applying a vacuum thereto whereby dirty scrubbing liquid is drawn through tube 23 into tank 19. Tube 23 is fluidly connected to a flexible line 24 that extends forwardly of the trailer unit. A vacuum is applied to the plenum chamber through passageway 25 which in turn is connected to the flexible conduit 27 extending between units 11, 12 and connected to the inlet of a suction blower 26 mounted on the power unit frame. A valve (not shown) may be provided in passageway 25 that when opened places the interior of passageway 25 in fluid communication with the atmosphere whereby no vacuum is applied to the plenum chamber even though the suction blower is running.

Figures 2, 9:
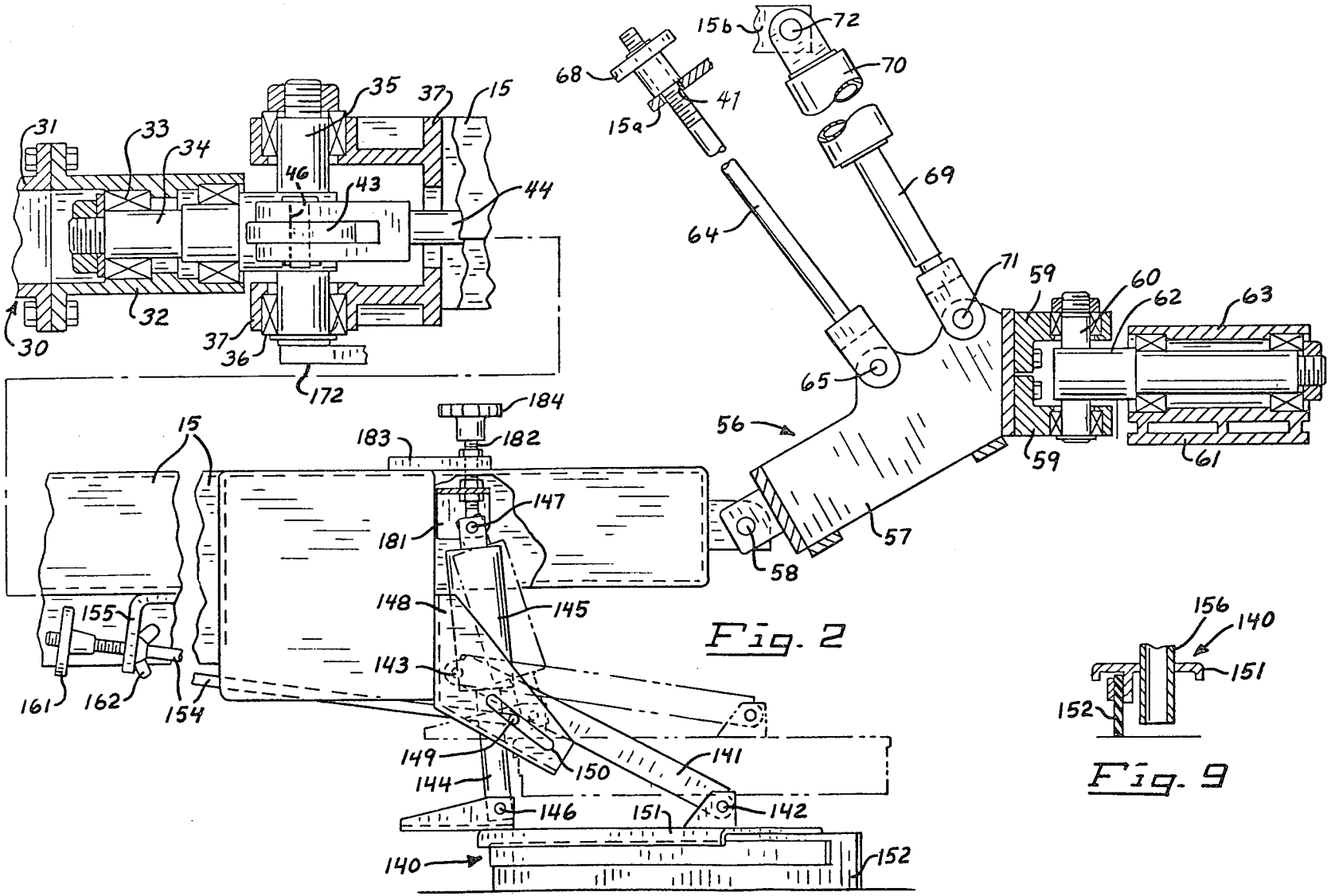
FIG. 2 is a fragmentary, vertical view of frame portions of the trailer and power units, the structure for pivotally connecting the trailer and power units and the power and scrubber head units respectively, and the squeegee assembly which is shown in a liquid collection position in solid lines and an elevated condition in dotted lines, portions of said view being broken away and other portions being shown in cross section.
FIG. 9 is a fragmentary longitudinal cross-sectional view of the center vacuum pickup and the squeegee assembly.

For towingly connecting the trailer unit to the power unit, there is provided a towing assembly, generally designated 30 that includes a transversely centerly located tow member 31 bolted to the main frame of the trailer unit to extend forwardly thereof, (see FIG. 2). One end of the tubular housing 32 is bolted to the front end of tow member 31 to extend forwardly thereof, the housing mounting spaced bearings 33 which mount a shaft 34 in a fixed axial position relative the housing for pivotal movement about a longitudinal, horizontal axis. The shaft 34 extends forwardly of the housing 32 to have the forward end thereof mount a second shaft 35 in a fixed position relative thereto with the central axis of shaft 35 perpendicular to the pivotal axis of the shaft 34 and shaft 35 extending outwardly of either side of shaft 34. Bearings 36 are mounted on the opposite end portions of shaft 35 to mount the shaft 35 for pivotal movement about a vertical axis in the rearward end of a clevised bracket 37 which is joined to the power unit frame 15 to extend rearwardly thereof.

Figure 11:
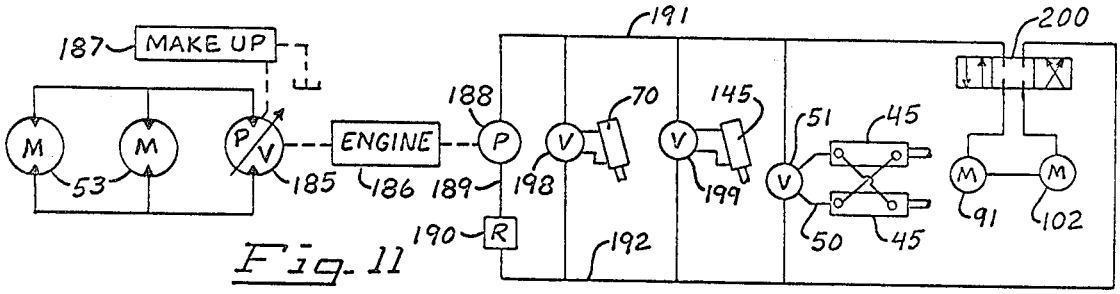
FIG. 11 is a simplified schematic showing part of the hydraulic circuitry and components of the apparatus of this invention.

For steering the power unit, the radially inner ends of radial arms 43 are joined to the forward end of the shaft 34 on the opposite sides of shaft 35 to extend horizontally outwardly thereof (see FIGS. 7 and 8), piston rods 44 of piston cylinder combinations 44, 45 being pivotally connected at 46 to the outer ends of arms 43. The cylinders 45 are pivotally connected at 47 to brackets 48 that are transversely spaced with one on either side of a center longitudinal vertical plane through the power unit. A steering wheel 54 on the power unit is connected to a valve 51 for operating the valve to apply fluid under pressure to the appropriate one of the lines 50 that are fluidly connected to the cylinders 45 for retracting one piston rod and extending the other piston rod (also see FIGS. 1 and 11). Valve 51 has a neutral position that no fluid under pressure is applied to either of cylinders 45 or fluid is permitted to escape therefrom. As a result, as the power unit is being driven, it can be turned in the appropriate direction. Mounted on the power unit frame on either side thereof is a drive wheel 52 which may be driven by a hydraulic motor 53. In turning on level surfaces, the power unit may pivot relative the trailer unit about the pivot axis of shaft 35, for example while turning, while if the units are moving over surfaces of various transverse inclinations the power unit and trailer unit may also pivot relative one another about the pivot axis of shaft 34.

In order to mount the scrubber head unit on the power unit to extend generally forwardly thereof, there is provided a mounting assembly, generally designated 56 (see FIGS. 1, 2, 3 and 6). The mounting assembly includes a generally trapezoidal bracket 57 that has one base edge pivotally connected to the central portion of the main frame 15 by a pivot member 58 for pivotal movement about its horizontal transverse axis. The opposite base of the bracket mounts a pair of generally vertically spaced pivot brackets 59 which in turn pivotally mount a pivot shaft 60 that has a pivot axis that is perpendicular to the axis of pivot 58. The rear end of an axially elongated shaft 62 is fixedly mounted on the intermediate portion of shaft 60 to have the central axis of shaft 62 extend perpendicular to the central axis of the shaft 60. A tubular housing 63 is rotatably mounted on the forward end portion of shaft 62 in a fixed axial position relative thereto, the housing 63 having a bracket 61 welded thereto. The bracket and tubular member 63 extend into a box shape housing 73 that is enclosed other than for a rear opening, and is formed by a rear upper central portion of the scrubber unit frame, the bracket 61 being bolted to the bottom wall of housing 73 whereby the scrubber unit frame, for the most part, extends downwardly and forwardly of the tubular housing 63.

A control rod 64 has one end pivotally connected at 65 to an intermediate portion of bracket 57 and an opposite end portion extending through an enlarged aperture 47 of frame portion 15*a* of the power unit frame, a nut 68 being threaded on rod 64 for adjustably limiting the downward movement of the rod relative frame portion and thereby the lowered position of the scrubber frame. Through the forementioned structure, the general lowermost elevation of the scrubbing unit can be controlled.

Figure 3:
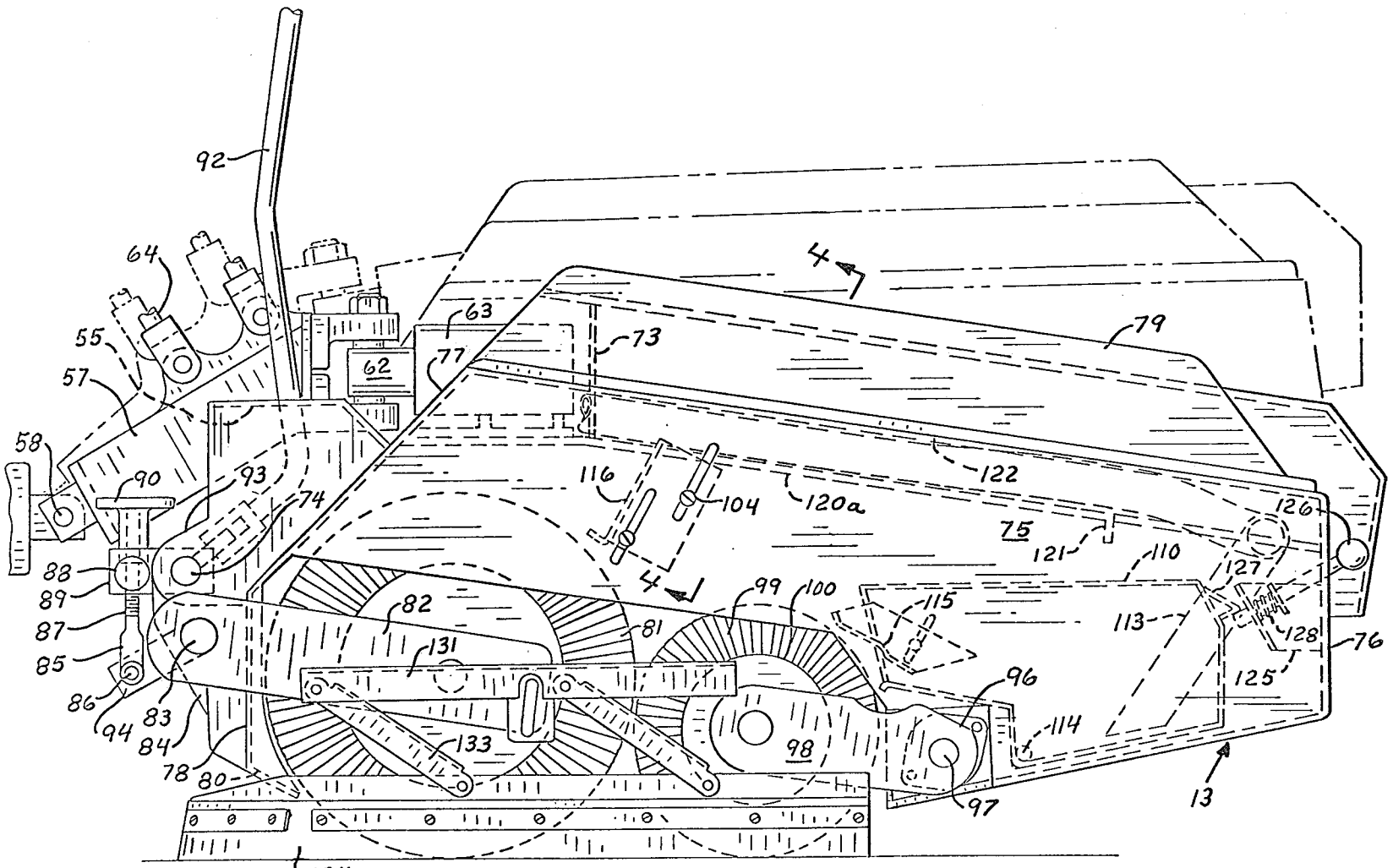
FIG. 3 is an enlarged vertical cross-sectional view of the scrubber head unit, said unit being shown in a scrubbing position in solid lines and in an elevated condition in dotted lines.

In order to move the scrubber head unit from the lowered solid line scrubbing position of FIG. 3 to the elevated dotted line travel position thereof (or a higher elevation), there is provided a piston cylinder combination 69, 70 that includes a piston rod 69 pivotally connected at 71 to the bracket 57 and a cylinder 70 that is pivotally connected at 72 to a frame portion 15*b* of the power unit frame 15. By applying fluid under pressure to the appropriate end of the cylinder, the scrubber head unit may be pivoted about the pivotal axis of pivot member 58.

In order to selectively resiliently retain the scrubber unit frame in a datum condition that the transverse brushes mounted thereon have their axes of rotation generally parallel to the surface that the power unit is on and parallel to the axes of rotation of the power unit wheels, one transverse side of bracket 57 pivotaly mounts one end of a coil spring 66 which has an opposite end pivotally connected to a turnbuckle 67. The opposite end of the turnbuckle is pivotally connected to the transversely adjacent, upper rear corner portion 13*a* of the scrubber unit frame. Likewise, a second coil spring 66 and a second turnbuckle 67 connects the opposite transverse side of bracket 57 to the other upper rear corner portion of the frame 13*a*.

By adjusting the effective lengths of the turnbuckle, with the scrubber unit in an elevated condition, the scrubber frame will be resiliently retained in a position that the axes of rotation of the brushes are parallel to the pivot axis of pivot 58 and perpendicular to the pivot axis of pivot 60. However, if it is desired to windrow the liquid on the surface, one turnbuckle may be loosened and the other tightened whereby one rear corner of the frame 13 will be resiliently retained substantially closer to the power unit frame than the transversely opposite corner, i.e. the axes of rotation of the brushes inclined in a generally horizontal plane from extending perpendicular to the direction of travel of the power unit.

By providing the above structure for mounting the scrubber unit on the power unit, the scrubber unit is free to pivot about the axis of pivot 58 to retain the brushes in engagement with a surface when, for example, the brushes engage an upwardly inclined ramp surface prior to the power unit wheels moving onto the ramp surface. Further if the scrubber unit is moved over a surface that is transversely inclined prior to the power unit wheels engaging said surface, the scrubber unit can pivot about the axis of pivot 62 to maintain the brushes in contact with such a surface throughout the axial length of the brushes. Additionally, if one front corner portion of the scrubber unit should abut against an obstruction, the scrubber unit is free to pivot a limited amount about the axis of pivot 60. Rubber bumpers (not shown) are provided on the rear portion of the scrubber frame that are normally substantially spaced from the power unit frame but are abuttable thereagainst to limit the pivotal movement of the scrubber unit about the axis of pivot 60.

Not previously mentioned is that bracket 61 is connected to the scrubber unit at a location that the scrubber unit will tend to pivot about the axis of pivot 62 to a position the axis of rotation of the brushes are parallel to the horizontal.

For purposes of describing the scrubber unit frame 13, it will be considered to be in the solid line scrubbing position of FIG. 3, the frame 13 including side walls 75, an upwardly and forwardly inclined rear wall 77 having the housing 73 welded thereto, a generally vertically extending rear wall 78 joined to the lower edge of wall 77, a downwardly and forwardly inclined rear wall 80 joined to the lower edge of wall 78 to be in partially underlying relationship to a rear portion of brush 81 and a top wall 120, 122, 120 that is welded to housing 73 and joined the members 75–77 to in cooperation therewith and housing 73 form a downwardly opening enclosure member.

The front ends of radial arms 82 respectively mount an idler plug (not shown) and a hydraulic motor 91 (FIG. 11), the idler plug and motor 91 mounting the rear tubular brush 81 for rotation about a transverse axis with the upper portion of the brush being within the enclosure member, and the rear walls 78, 80 extending downwardly in back of the brush a substantial distance below the upper half of the brush as indicated in FIG. 3.

The opposite ends of the arms 82 are keyed to a transverse shaft 83 which in turn is mounted for pivotal movement by brackets 84 secured to the rear wall 78 to extend rearwardly thereof. In this connection it is to be noted that each vertical edge of the rear walls 78, 80 are located transversely inwardly of the adjacent edge of the upper portion of inclined rear wall 77 to which the side walls are secured. One end of a bar 94 is welded to rod 83 while the opposite end of the bar is pivotally connected at 86 to a clevis bracket 85 which in turn has one end of a rod 87 pivotally connected thereto in an axially fixed position. The intermediate portion of the rod 87 is threadingly extended through a pivot member 88 that is mounted by a clevis bracket 89, a handle 90 being secured to rod 87 for adjustably threading rod 87 in pivot member 88 to provide an adjustment for brush wear. Bracket 89 is welded to a rod 74 which in turn is pivotally mounted by brackets 93 secured to the scrubber unit frame. A lever 92 has one end connected to rod 74 for pivotal movement about an axis perpendicular to that of rod 74 for pivoting the rod. Lever 92 has an intermediate portion extended up through a notched plate 55 (the notches not being illustrated) for releasably retaining the lever and thereby the brush 81 in various select positions that include (1) a free float condition, (2) a position exerting downward pressure on the brush when the scrubber unit is in the solid line scrubbing condition; and (3) an elevated condition off the surface even when the scrubber unit is in the scrubbing position. Plate 55 is mounted on frame 13.

A downwardly opening, generally U-shaped channel 95 extends between the frame side walls 75 and is secured thereto intermediate brush 99 and wall 76, said channel in turn mounting bearing members 96 which in turn pivotally mount a transverse shaft 97 within the channel. Each end portion of shaft 97 has one end of a brush mounting arm 98 keyed thereto, the opposite ends mounting an idler plug 100 and a hydraulic motor 102 that mount the respective end of the tubular brush 99 that is of a substantially smaller diameter than brush 81. The axis of rotation of brush 99 is parallel to that of brush 81, brushes 81, 99 in scrubbing positions having closely adjacent outer peripheral portions. The arms 98 extend through narrow slots formed in the rear wall of the channel 95 to permit limited free floating movement of the brush 99, a stop (**98*b*) being mounted by the channel to abut against projection 98*a* secured to one of the arms 98 for limiting the pivotal movement of the arms 98 in a direction of arrow 101 about the axis of shaft 97** while the top of the channel limits pivotal movement in the opposite direction.

Located longitudinally between the front brush 99 and the front wall 76 is a debris hopper generally designated 105. The debris hooper has a rear wall 106 that in the scrubbing unit normal scrubbing position extends first downwardly and slightly rearwardly, thence along an intermediate portion that extends predominately rearwardly in overhanging relationship to the channel 95 and thence vertically downwardly along the front wall of the channel. Further, the debris hopper has a bottom wall 108 and a front wall 107 that is substantial distance rearwardly of frame front wall 76. The front wall 107 extends to a substantially higher elevation than the rear wall 106. The hopper also includes a side wall 110 closely adjacent the right scrubber unit side wall 75, and at the other transverse end includes a lower side wall portion 109. A short distance transversely more closely adjacent side wall 110 than side wall portion 109 there is provided a side wall portion 111 that extends downwardly to a slightly lower elevation than the top edge of side wall portion 109 and upwardly to the same elevation as the top of side wall 110, the front and rear walls intermediate wall portions 110, 111 extending to the same elevation as wall portion 109. A metal vacuum pickup tube 113 is mounted within the enclosure formed by the scrubbing unit frame in a fixed condition to extend downwardly into the debris hopper transversely between side wall portions 109, 111 and closely adjacent wall 108. As a result of the debris hopper being of the aforementioned construction, the hopper may pivot from the solid line position of FIG. 5 to the dotted line position thereof without the tube 113 being moved, the debris hopper being provided with transverse pivot members 114 that are attached to the side wall portion 109 and side wall 110 closely adjacent the front wall of channel 95 and closely adjacent the juncture front wall 106 and bottom wall 108, and are mounted by the frame side walls 75. A screen 117 is provided in the debris hopper and extends from the side wall portion 111 to the bottom wall and between walls 106, 107, the one ends of the brushes being longitudinally aligned or transversely inwardly of wall portion 111.

A transverse row of apertures 118 are provided in the hopper rear wall 106 at a substantially higher elevation than the bottom wall 108 and a lower elevation than the top of wall portion 109 to permit drainage of liquid from the hopper interior to fall onto the surface to be cleaned in front of brush 99. The apertures are at a substantially higher elevation than the inlet of tube 113.

Figure 5:
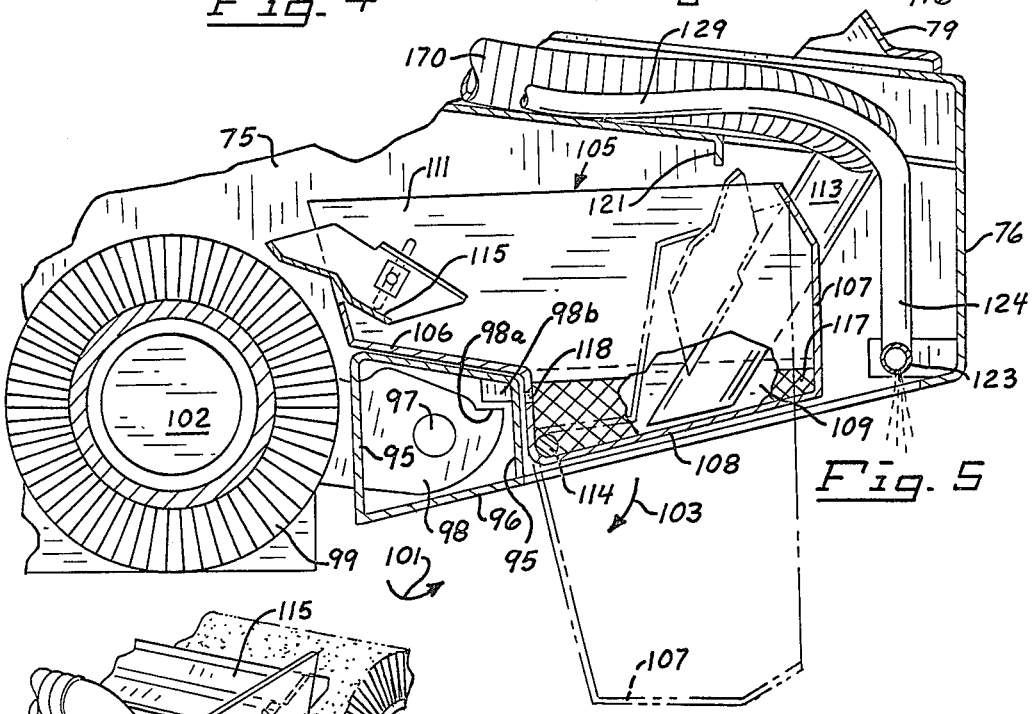
FIG. 5 is a fragmentary, vertical cross-sectional view generally taken along the line and in the direction of the arrows 5—5 of FIG. 4 to show the mounting of the debris hopper, the debris hopper being shown in a normal scrubbing position in solid lines, and in a dumping position in dotted lines.
Figure 10:
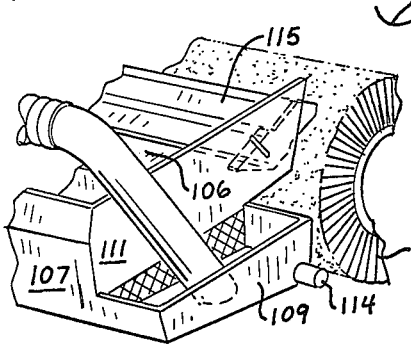
FIG. 10 is a fragmentary perspective view of the left hand end portion of the debris hopper and the vacuumized liquid pickup for withdrawing liquid from said hopper.
Figure 6:
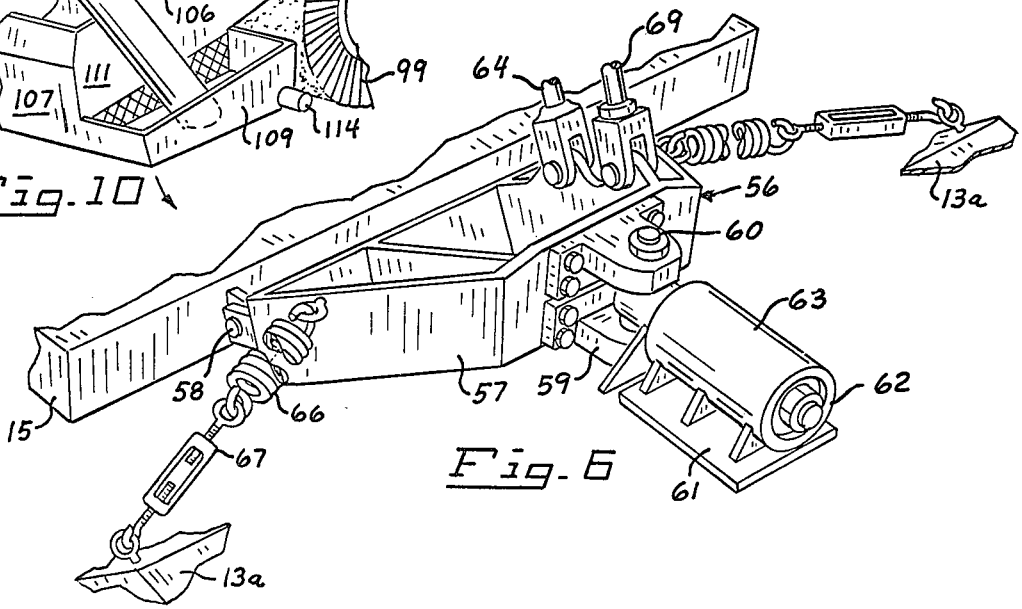
FIG. 6 is an enlarged perspective view of the structure for connecting the scrubber head unit to the power unit.

A bracket 125 is mounted by the front wall 76 to have a latch bolt 126 slidably extended through appropriate apertures in said bracket and the front wall between a position with one end in underlying relationship to a bracket 127 mounted on the front wall of the hopper and a retracted position to releasably retain the hopper in the solid line position of FIG. 5. A spring 128 is mounted on bolt 126 to resiliently retain the bolt in its extended position. The center of gravity of the hopper is forwardly of pivots 114, and upon retracting bolt 126, the hopper pivots in the direction of arrow 103 to an emptying position extending below the scrubber unit frame and opening forwardly to facilitate cleaning.

A baffle 115 is mounted by side wall 110 and side wall portion 111 for pivotal movement between a position extending above and forwardly of the upper terminal edge of wall 106 in overhanging relationship to the upper forward part of brush 99 and a generally vertically extending position, and can be adjustably spaced from the brush 99 in a given pivotal position. The baffle is biased toward a brush overhanging position by a spring (not shown) to a given pivot position limited by a stop (not shown), but is free to pivot toward the general vertical condition in the event brush 99 pivots upwardly.

The baffle aids in deflecting material raised by the brushes into the hopper when the baffle and hopper are in the solid line positions of FIG. 5.

A baffle 116 extends between side walls 75 in overhanging relationship to the rear portion of brush 81, and is inclined rearwardly and predominately upwardly to aid in deflecting material raised by the brushes toward the debris hopper. Screws 104 are extended through slots in the frame side walls 75 to retain the baffle in selected adjusted positions.

Figure 4:
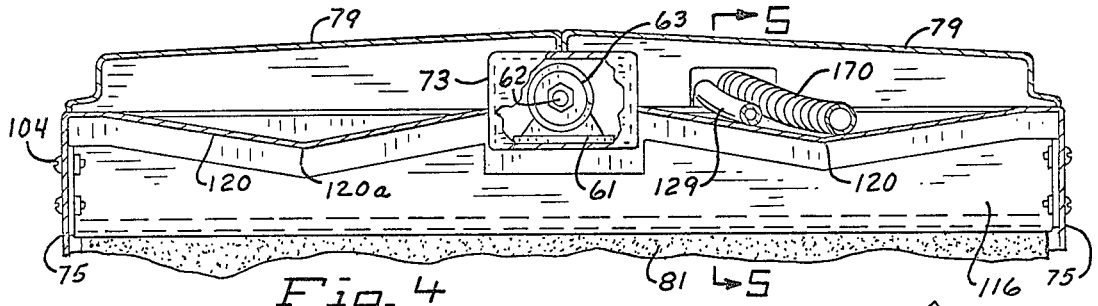
FIG. 4 is a fragmentary transverse cross-sectional view generally taken along the line and in the direction of the arrows 4—4 of FIG. 3 to illustrate the deflector members of the scrubbing head unit.

The top wall of the scrubber frame includes a pair of transversely spaced, longitudinally elongated deflectors 120 that are generally V-shaped in transverse cross section (see FIGS. 3 and 4). When the scrubber head unit is in normal scrubbing position, the deflectors 120 are inclined downwardly and predominently forwardly from a location in part in overhanging relationship to the rear brush 81 to terminate at a depending flange 121 that is in an overhanging relationship to the front part of the debris hopper whereby drops of water running down and forwardly along the surface of the deflectors will be directed downwardly into the hopper by the flange. Further, since the depending apex portions 120*a* of the deflectors are parallel to one another, extend longitudinally and are spaced a substantial distance inwardly of the outer ends of the brushes, most of any liquid on the deflectors that drips off the deflectors rearwardly of the hopper will drip off the apex positions intermediate the ends of the brushes. A planar panel 122 has opposite longitudinal edges joined to the adjacent terminal edges of deflectors 120, extends in a plane parallel to apex edges 120*a*, and extends from housing 73 to flange 121. Cover portions 79 are removably mounted on the top wall 120, 122, 120.

A transverse liquid distributor 123 is mounted by frame 13 between the debris hopper and the frame front wall 76 to direct scrubbing liquid downwardly through the bottom opening of the enclosure member. A pipe 124 is fluidly connected to distributor 123 and is connected to a flexible conduit 129 which extends between a wall portion 120 and cover portion 79, thence through the power unit and to the trailer unit and is fluidly connected to the lower end of cleaning solution tank 18 to permit a liquid gravity flow from the tank to the distributor. A shut off valve (not shown) is provided in line 129 to control the flow of liquid through said line.

Referring to FIG. 3, on each transverse side of the scrubber head unit transversely outwardly of the brushes there is provided a squeegee mounting bar 131 that is bolted to the adjacent arm 82, parallel linkage members 133 being pivotally connected to the bar 131 and to the side squeegee 134. A chain (not shown) may be connected between the squeegee and the bar 131 for retaining the squeegee 134 in an adjusted spaced relationship to the bar. The squeeges 134 are of lengths to extend from forwardly of brush 99 to rearwardly of brush 81.

Referring now to FIGS. 1, 2, 7 and 9, a squeegee assembly, generally designated 140, is mounted on the power unit forwardly of the power unit wheels 52, a pair of links 141 being pivotally connected at 142 to transversely spaced apart end portions of the squeegee assembly and having rearward ends pivotally connected at 143 to brackets 148 that are fixedly attached to the main frame 15. Each link 141 has its rearward end portion extending between the parallel vertical legs of the respective bracket 148 in overlying relationship to a transverse rod 149 that is slidably mounted in the upwardly and rearwardly inclined slots 150 formed in said legs. An adjustment rod 154 has one end attached to each rod 149 and an opposite end slidably extended through a bracket 155 on a frame. An adjusting knob 161 and lock unit 162 are threaded on each rod 154 to abut against bracket 155 for retaining rods 154, 149 in select adjusted positions. By varying the adjustment of rods 154, the lowermost elevation of the squeegee assembly end portions may be controlled. A piston cylinder combination 144, 145 includes a piston rod 144 that is pivotally connected at 146 to the central part of the squeegee assembly rearwardly of pivots 142 and a cylinder 145 that is pivotally connected at 147 to a bracket 181. Bracket 181 is dependingly mounted by a bolt 182 to move vertically therewith, the bolt being extended through an enlarged aperture in bracket 181 and threadingly extended through a bracket 183 that is welded to the frame 15. An adjustment knob 184 and a jam nut are provided on the bolt. Through members 181–184, the height of the cylinder 145 and thereby the lowermost position of the central portion of the squeegee assembly may be adjusted. Upon applying fluid under pressure to the lower end of the cylinder 145, the squeegee assembly is moved from the downward solid line position liquid collecting position of FIG. 2 to the dotted line travel position of said Figure; and upon applying fluid under pressure to the upper end of said cylinder, the squeegee assembly is moved to its downward position.

The squeegee assembly includes a frame 151 that dependingly mounts a squeegee 152 that extends transversely outwardly of each side of the power unit frame. The squeegee may be made of rubber or suitable flexible elastomeric material.

Figure 7:
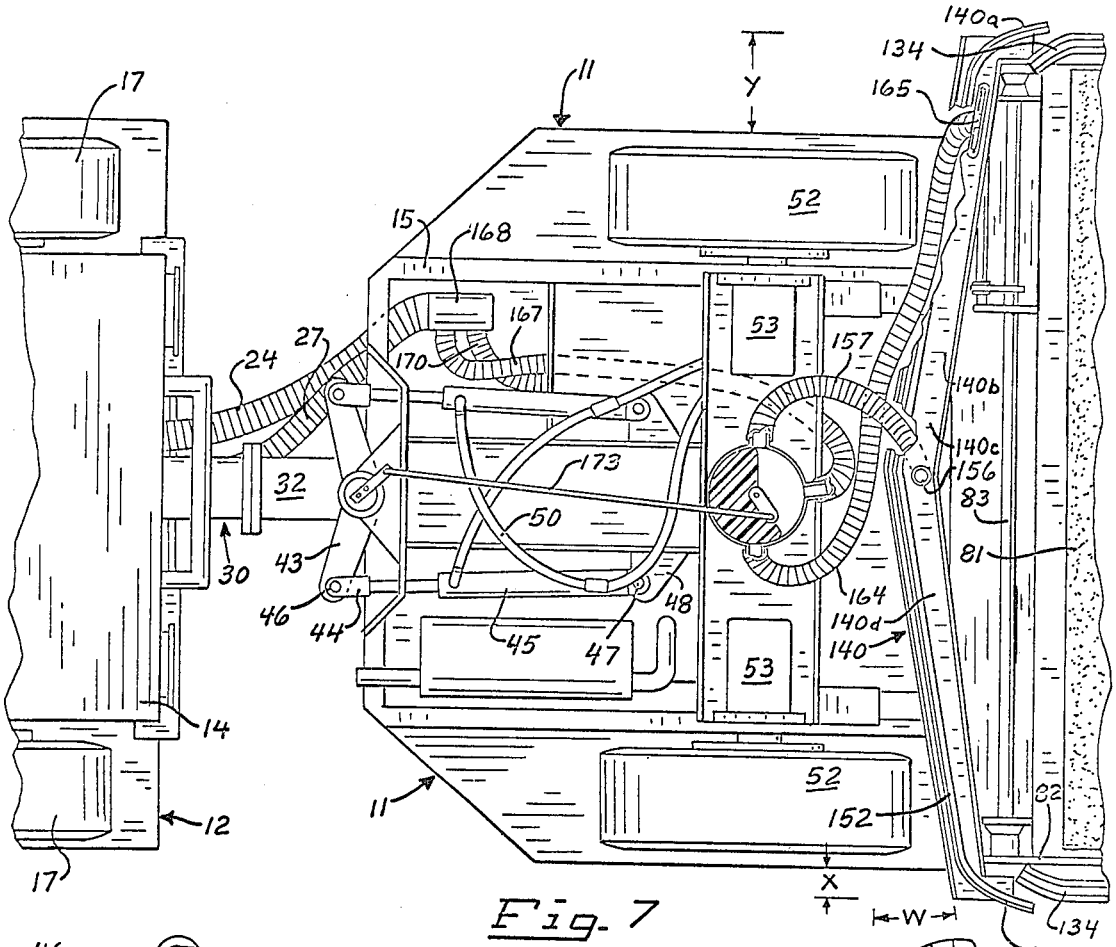
FIG. 7 is a fragmentary bottom view of the power unit and the adjacent portions of the trailer unit and scrubber head unit.
Figure 8:
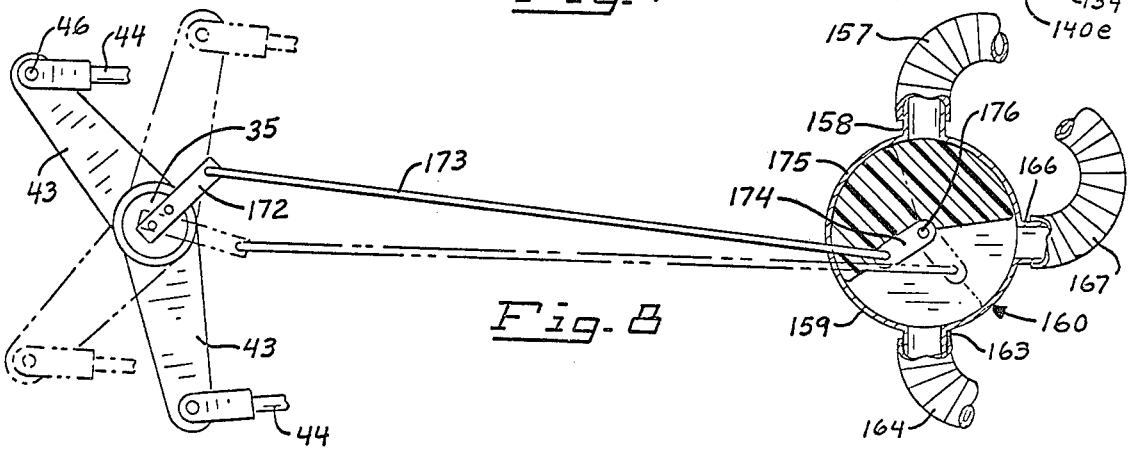
FIG. 8 is an enlarged view of the suction manifold and the structure for operating said manifold between its positions, said view showing the manifold in a position for supplying suction to the right-side vacuum pickup in solid lines and to the center vacuum pickup in dotted lines.

As may be noted from FIG. 7, the squeegee assembly includes portions 140*b*, 140*d* that are joined together at center portion 140*c* and extend outwardly of on either side of portion 140*c* in forwardly and predominately outwardly directions. Joined to the outer ends of portions 140*b*, 140*d* are end portions 140*a*, 140*e* respectively which extend outwardly and predominately forwardly; portions 140*a*, 140*e* being located transverse outwardly and extending slightly forwardly of the rear portions of the adjacent squeegees 134, 134.

A liquid pickup tube 156 extends downwardly through the frame 151 in front of squeegee 152 adjacent portion 140*c*, and terminates at a slightly higher elevation than squeegee 152. A flexible conduit 157 has one end connected to the upper end of tube 156 and an opposite end that opens through port 158 into the interior of the housing 159 of the vacuum control valve generally designated 160. A second port 163 of the housing that is diammetrically opposed from port 158 is fluidly connected by a conduit 164 to the liquid pickup member 165 which extends through the squeegee frame adjacent the juncture of squeegee portions 140*b*, 140*a* and forwardly of portion 140*b*. A third port 166 which opens to the housing angularly between ports 158, 163, is fluidly connected by a line 167 to a port of a control valve 168 which has a second port to which the conduit 24 is connected. A third port of valve 168 is fluidly connected by a flexible conduit 170 to the pickup tube 113, conduit 170 extending through the appropriate aperture in the cover of the scrubbing unit housing and between the cover and one of top wall portions 120 such as indicated in FIGS. 4 and 5. Valve 168 is of a construction to selectively permit the application of vacuum from line 24 to both of lines 167, 170 or to line 167 only.

One end of an arm 172 is fixedly attached to the pivot member 35 while the opposite end of the arm pivotally mounts one end of the rod 173. The opposite end of the rod is pivotally mounted by an arm 174 that is keyed to a shaft 176. The shaft 176 extends into the valve housing 159 and has a valve member 175 mounted thereon to rotate therewith for blocking fluid communication between various ports 158, 163, 166 as will be more fully set forth hereinafter.

As may be in part noted from FIG. 7, when the apparatus of this invention is in a straight ahead travelling acrubbing condition, the sides at the trailer and power unit are generally longitudinally aligned while the left hand squeegee 134 of the scrubber head unit extends transversely outwardly of the left side of the frame by a dimension X (see FIG. 7) and the right hand squeegee extends transversely outwardly relative the right side of the power unit by a dimension Y. As may be noted the dimension Y is many times greater than the dimension X. Further, the steering wheel 54 and the operator's seat 179 are provided on the right hand side of the power unit. As a result, the operator is situated in a position to observe the right hand side of the scrubber unit which is desirable when scrubbing closely adjacent a wall on the right hand side, and at the same time the power unit is further offset from the wall than the right hand side of the scrubber unit. In order to aid in preventing the scrubber head unit from scraping against a vertical wall on the right side, a plastic or rubber wheel 180 is mounted on the right front corner portion of the scrubber unit to extend further outwardly than the scrubber unit frame and the right hand squeegee to be abuttable against the vertical wall while at the same time permitting the right hand squeegee 134 being located closely adjacent the vertical wall.

Since the hydraulic components and circuitry of the present invention may be very similar to that disclosed in co-pending application Ser. No. 72,275, filed Sept. 15, 1970, with reference to FIG. 9 thereof, other than this invention includes the addition of a reversing valve for the brush motors and hydraulic components for controlling the steering of the vehicle, only a very abbreviated description thereof will be made in this application. Thus with reference to FIG. 11, a commercially available variable displacement piston type pump 185 driven by engine 186 pumps oil through the power unit wheel motors 53 in a closed circuit. A suitable hydraulic makeup circuit 187 takes care of leakage losses and the like in the closed circuit. The pump 185 is an overcenter pump that may provide reverse flow through motors to control the direction of rotation of the motors and the speed of rotation as well as providing a stop position.

Engine 186 drives the suction blower 26 and also drives a hydraulic pump 188 that is provided for the various auxiliary components. A line 189 fluidly connects the pump 188 to reservoir 190, a pressure line 191 being connected to the pump pressure port and a return line 192 being connected to reservoir. A valve 198 is connected between lines 191, 192 for controlling the application of fluid under pressure to the cylinder 70 for selectively raising, lowering and retaining the scrubber unit in its maximum elevated position, its lowered scrubbing position and positions therebetween. Further, a valve 199 is connected across lines 191, 192 for controlling the application of fluid under pressure to cylinder 145 for raising and lowering the squeegee assembly. Also connected across lines 191, 192 is a valve 200 for selectively applying no fluid under pressure to brush motors 91, 102; or to rotate said motors to turn in the direction of arrows 182, 183 respectively; or to rotate said motors in the direction opposite arrows 182, 183 respectively. The valve 51 is connected across lines 191, 192 to control the operation of the steering piston cylinder combination as previously indicated. Advantageously, line 191 may be two different lines connected to different pressure ports and the various valves connected to the appropriate one of the two lines, and additional check valves, pressure relief valves and bypass valves may be provided in the circuit illustrated.

In using the apparatus of this invention with brush 81 being substantially larger in diameter than brush 99 and brushes 81, 99 rotating in opposing directions with the portions contacting the surface rotating toward one another (in direction of the arrows 182, 183 respectively), most of the debris raised by the brushes will go over the small brush 99 and be directed into the debris hopper 105. In this connection the generally forward and downward sloping of the deflectors 120 aid in directing debris into the hopper 105.

Assuming that scrubbing liquid tank is fluidly connected to the distributor 123 for dispensing scrubbing liquid onto the surface being cleaned ahead of the brushes, or if liquid already is present on said surface, the rotation of the brushes in the direction of arrows 182, 183 will cause the liquid and other debris on the surface to rise with a substantial part of the raised liquid moving directly into the debris hopper. Also some of the raised liquid will impinge upon the deflectors 120 and the panel therebetween, and will run along the deflectors and panel therebetween, and will run along the deflectors and panel to the flange 121 to drain down into the debris hopper. In the event no vacuum is being applied to tube 113, the liquid level in the pan will raise to the level of the apertures 118 and thence drain out through the apertures to fall back onto the surface being scrubbed at a location ahead of the scrubbing brushes. In such an event, part of the scrubbing liquid would be recycled. However, if the valve 168 is in a position for applying a vacuum through line 170 to tube 113, thence scrubbing liquid is drawn from the hopper through tube 113, conduit 170, valve 168 and conduit 24 to be collected in tank 19.

To be mentioned is that with the brushes being driven in the direction of arrows 182, 183, the brushes maintain a pool of liquid therebetween which provides for a better scrubbing action as contrasted where the brushes rotate in the same direction with merely a film of liquid therebetween. Advantageously the brushes may have a herringbone arrangement of bristles that, with the brushes rotating, direct the scrubbing liquid toward a transverse central location between the brushes to aid in minimizing the amount of liquid that otherwise may pass through the narrow space between the ends of the brushes and the adjacent side squeegee.

If it is desired to use the apparatus for a surface soaking operation, the direction of rotation of the brush motors is reversed to drive the brushes 81, 99 in the direction opposite arrows 182, 183 respectively and the squeegee assembly is left in its elevated position. As a result the brushes raise very little liquid from the surface but do agitate the liquid on the surface. Thereafter the apparatus may go over the surface again with the brushes rotating in the direction of the arrows 182, 183 to pick up most of the dirty liquid and debris; and the squeegee assembly may be lowered to squeegee up liquid not collected in the debris hopper.

When the power unit is travelling straight forwardly with reference to the trailer unit, the linkages 172–174 retain the valve member 175 in a position that port 163 is blocked, but the ports 158, 166 are in fluid communication with one another through the housing 159. As a result, the vacuum in conduit 24 is applied through conduit 167 to the squeegee pickup tube 156.

When the power unit is turned through a substantial angle to the left with reference to the straight forward direction of a trailer unit, for example angle W of portion **140*d* relative a transverse direction which may be about 20°, the power unit in pivoting relative shaft 35 and the arm 172 bolted thereto results in the valve member 175 being rotated in the housing 159 to a position to block port 158 and place port 163 in fluid communication with port 166. As a result, no vacuum is applied at the takeup tube 156 but a vacuum is applied at the takeup inlet 165. The advantage of shifting the vacuum from tube 156 to tube 165 is that in turning in a left hand direction the squeegee assembly moves relative to the puddle of liquid on the surface so that most of the liquid is closer to takeup 165 than tube 156. Thus, applying the vacuum at 165 collects liquid at the location where the bulk is located and collects liquid that might otherwise escape at the side of the apparatus of this invention. To be mentioned, with the apparatus described, it is assumed that most of the turns will be in a left hand direction. However, in the event that most of the turns were in a right hand direction, then the takeup 165 could be provided adjacent the juncture of the squeegee assembly portions 140*d*, 140*e* and the linkages 172–174 changed so that the vacuum would be applied at the left hand corner portion of the squeegee when a right hand turn were being made; or the control valve 160 may be modified, a liquid pickup tube mounted adjacent the juncture of portions 140*d*, 140*e* and connected to the control valve to pick up liquid at adjacent portions 140*d*, 140*e* when the power unit is turned in the right hand direction and pick up liquid through member 165** when turned in a left hand direction.

As previously indicated, by appropriately tightening one turnbuckle and loosening the other turnbuckle, the scrubber unit can be used for windrowing liquid. Also under some scrubbing conditions a better scrubbing action can be obtained by having the scrubber unit inclined relative the power unit as set forth for windrowing liquid. In this connection it is to be noted that at this time the axes of rotation of the brushes would be inclined at a substantial arcuate angle to a transverse direction.

Also to be mentioned is that the apparatus of this invention may be used for a sweeping operation.

What is claimed is

1. A maintenance machine for surfaces such as a floor or the like comprising a vehicle having a frame, ground engaging wheels and a dirty scrubbing liquid collection tank, a power driven brush, first means for mounting the brush on the frame, squeegee means mounted on at least one of the frame and the first means for collecting scrubbing liquid from the surface over which the brush is moved, said squeegee means including a squeegee assembly having a central portion, and forwardly and transversely extending elongated portions joined to the central portion and extending outwardly on either transverse side thereof, said squeegee assembly being of a transverse width of at least about as great as said brush and extending transversely rearwardly of the brush, a first liquid collection member having an inlet located adjacent the squeegee assembly central portion for withdrawing liquid from the surface between the central portion and the brush, a second liquid collection member having an inlet located adjacent one of the forwardly and transversely extending elongated portions, remote from the squeegee assembly central portion and transversely offset from the first collection member inlet for withdrawing liquid from the surface between the squeegee assembly and the brush, and second means connected to the tank and to each of said collection members for drawing liquid from the surface and through the collection members and transferring the liquid to the tank.

2. The apparatus of claim 1 further characterized in that the vehicle has means for steering the vehicle to turn the vehicle, and that the second means includes operable means for blocking fluid flow from the second collection member to the tank and alternately fluidly connecting the second collection member to the tank for transferring liquid to the tank and means operated by the turning of the vehicle from a straight ahead direction of travel in a direction opposite that from which the second collection member is transversely offset from the first collection member for operating said operable means from its fluid flow blocking condition to its fluidly connecting condition for transferring liquid from the second collection member to the tank.

3. The apparatus of claim 1 further characterized in that said squeegee means includes side squeegees mounted adjacent and on transverse opposite sides of the brush and having rearward end portions adjacent the squeegee assembly and transversely inwardly of the terminal ends of the squeegee assembly.

4. The apparatus of claim 3 further characterized in that the vehicle has means for steering the vehicle to turn the vehicle, and that the second means includes operable means for blocking fluid flow from the second collection member to the tank and alternately fluidly connecting the second collection member to the tank for transferring liquid to the tank and means operated by the turning of the vehicle from a straight ahead direction of travel in a direction opposite that from which the second collection member is transversely offset from the first collection member for operating said operable means from its fluid flow blocking condition to its fluidly connecting condition for transferring liquid to the tank.

5. A maintenance machine for surfaces such as a floor or the like comprising a power unit having a main frame, and power driven wheels mounted on the main frame, a trailer unit having a trailer frame, a dirty scrubbing liquid tank, and surface engaging wheels mounted on the trailer frame, first means for towingly connecting the trailer unit to the power unit, said first means including a tow member attached to the trailer frame, a mounting member attached to main frame to extend rearwardly thereof and joint means for connecting the tow member to the mounting member for relative pivotal movement about a generally vertical first axis and a second axis parallel to a straight ahead direction of movement of the power and trailer units, said joint means including a shaft mounted by the tow member for pivotal movement about the second axis and having a first end portion extending forwardly of the tow member, and a second pivot member fixedly attached to the first end portion, said second pivot member being pivotally mounted by the mounting member for pivotal movement about the first axis, a steering member on the power unit, an arm fixedly joined to at least one of the pivot members and means actuated by moving the steering member to exert a steering force on said arm, a maintenance unit including a maintenance unit frame having a downwardly opening enclosure, a power driven first brush and second means for rotatably mounting the brush on the maintenance frame to extend within the enclosure, third means for mounting the maintenance unit on the power unit to at least in part be supportingly carried by the power unit, means for collecting dirty scrubbing liquid from the surface over which said brush is moved, said collecting means being mounted on at least one of said power unit and maintenance unit, and means for transferring liquid from the collecting means to said tank, said collecting means including a squeegee assembly mounted on one of said power and maintenance units, having a transverse width at least about as great as said brush, and being located rearwardly of said brush, said squeegee assembly having a transverse central portion and a forwardly extending end portion transversely remote from the central portion, the means for transferring liquid including a first pickup member adjacent the central portion for withdrawing liquid from the surface adjacent said central portion, a second liquid pickup member adjacent said forwardly extending end portion for withdrawing liquid from the surface adjacent said end portion, and fourth means for drawing liquid from said pickup members and conducting the liquid to the tank, said fourth means including operable fifth means for selectively conducting liquid from the first pickup member and from the second pickup member to the tank, and sixth means fixedly attached to one of the pivot members and operatively connected to the fifth means for operating the fifth means to fluidly connect the first pickup member to the tank to conduct liquid to the tank when the power unit and trailer unit are traveling straight ahead and alternately the second pickup member to the tank to conduct liquid to the tank when the power unit is turning from a straight ahead direction of travel in a direction opposite that which said end portion is transversely offset from the central portion.

6. A maintenance machine for surfaces such as a floor or the like comprising a power unit having a main frame, and power driven wheels mounted on the main frame, a trailer unit havng a trailer frame, a dirty scrubbing liquid tank, and surface engaging wheels mounted on the trailer frame, first means for towingly connecting the trailer unit to the power unit, said first means including a tow member attached to the trailer frame, a mounting member attached to main frame to extend rearwardly thereof and joint means for connecting the tow member to the mounting member for relative pivotal movement about a generally vertical first axis and a second axis parallel to a straight ahead direction of movement of the power and trailer units, said joint means including a shaft mounted by the tow member for pivotal movement about the second axis and having a first end portion extending forwardly of the tow member, and a second pivot member fixedly attached to the first end portion, said second pivot member being pivotally mounted by the mounting member for pivotal movement about the first axis, a steering member on the power unit, an arm fixedly joined to at least one of the pivot members and means actuated by moving the steering member to exert a steering force on said arm, a maintenance unit including a maintenance unit frame having a downwardly opening enclosure, a power driven first brush and second means for rotatably mounting the brush on the maintenance frame to extend within the enclosure, third means for mounting the maintenance unit on the power unit to at least in part be supportingly carried by the power unit, means for collecting dirty scrubbing liquid from the surface over which said brush is moved, said collecting means being mounted on at least one of said power unit and maintenance unit and including a vacuum source connectd to the tank for applying a vacuum thereto, and means for transferring liquid from the collecting means to said tank, said collecting means including a squeegee assembly mounted on one of said power and maintenance units, having a transverse width at least about as great as said brush, and being located rearwardly of said brush, said squeegee assembly having a transverse central portion and a forwardly extending end portion transversely remote from the central portion, the means for transferring liquid including a first liquid pickup member adjacent the central portion for withdrawing liquid from the surface adjacent said central portion, a second liquid pickup member adjacent said forwardly extending end portion for withdrawing liquid from the surface adjacent said end portion, and fourth means for drawing liquid from said pickup members and conducting the liquid to the tank, said fourth means including fifth means for selectively conducting liquid from the first pickup member to the tank, said fifth means including a valve housing and a valve member rotatably mounted in the housing, and sixth means fixedly attached to one of the pivot members and operatively connected to the fifth means for operating the fifth means to fluidly connect the first pickup member to the tank when the power unit and trailer unit are traveling straight ahead and alternately the second pickup member to the tank when the power unit is turning from a straight ahead direction of travel in a direction opposite that from which said end portion is transversely offset from the central portion, said sixth means being connected to the valve member for rotating it as the power unit in moving forwardly turns relative the trailer unit.

7. A maintenance machine for surfaces such as a floor or the like comprising a power unit havng a main frame, and power driven wheels mounted on the main frame, a trailer unit having a trailer frame, a dirty scrubbing liquid tank, and surface engaging wheels mounted on the trailer frame, first means for towingly connecting the trailer unit to the power unit, said first means including a tow member attached to the trailer frame, a mounting attached to main frame to extend rearwardly thereof and joint means for connecting the tow member to the mounting member for relative pivotal movement about a generally vertical first axis and a second axis parallel to a straight ahead direction of movement of the power and trailer units, said joint means including a shaft mounted by the tow member for pivotal movement about the second axis and having a first end portion extending forwardly of the tow member, and a second pivot member fixedly attached to the first end portion, said second pivot member being pivotally mounted by the mounting member for pivotal movement about the first axis, a steering member on the power unit, an arm fixedly joined to at least one of the pivot members and means actuated by moving the steering member to exert a steering force on said arm, a maintenance unit including a maintenance unit frame having a downwardly opening enclosure, a power driven first brush and second means for rotatably mounting the brush on the maintenance frame to extend within the enclosure, third means for mounting the maintenance unit on the power unit to extend forwardly of the power unit and at least in part be supportingly carried by the power unit, means for collecting dirty scrubbing liquid from the surface over which said brush is moved, said collecting means being mounted on at least one of said power unit and maintenance unit, and means for transferring liquid from the collecting means to said tank, said collecting means including a squeegee assembly mounted on the power unit between said wheels and said brush, having a transverse width at least about as great as said brush, and being located rearwardly of said brush, said squeegee assembly having a transverse central portion and a forwardly extending end portion transversely remote from the central portion, the means for transferring liquid including a first liquid pickup member adjacent the central portion for withdrawing liquid from the surface adjacent said central portion, a second liquid pickup member adjacent said forwardly extending end portion for withdrawing liquid from the surface adjacent said end portion, and fourth means for drawing liquid from said pickup members and conducting the liquid to the tank, said fourth means including fifth means for selectively conducting liquid from the first pickup member to the tank, and sixth means fixedly attached to one of the pivot members and operatively connected to the fifth means for operating the fifth means to fluidly connect the first pickup member to the tank when the power unit and trailer unit are traveling straight ahead and alternately the second pickup member to the tank when the power unit is turning from a straight ahead direction to travel in a direction opposite that which said end portion is transversely offset from the central portion, the maintenance unit including side squeegees mounted on the maintenance frame adjacent the opposite ends of the brush and having rearward end portions adjacent the squeegee assembly and transversely inwardly of the terminal ends of squeegee assembly.

8. A maintenance machine for surfaces such as a floor or the like comprising a vehicle having a frame, ground engaging wheels and a dirty scrubbing liquid collection tank, a power driven brush, first means for mounting the brush on the frame, squeegee means mounted on at least one of the frame and the first means for collecting scrubbing liquid from the surface over which the brush is moved, said squeegee means including a squeegee assembly having a central portion, forwardly and predominantly transversely extending elongated portions joined to the central portion and extending outwardly on either transverse side thereof, and a generally forwardly extending end portion joined to one of the transverse portions transversely remote from the central portion, said squeegee assembly being of a transverse width of at least about as great as said brush and extending transversely rearwardly of the brush, a first liquid collection member having an inlet located adjacent the squeegee assembly central portion for withdrawing liquid from the surface between the central portion and the brush when a liquid withdrawing force is applied thereto, a second liquid collection member having an inlet located adjacent the juncture of the generally forwardly extending end portion to the transversely extending portion to which it is joined for withdrawing liquid from the surface between the squeegee assembly and the brush, and second means connected to the tank and to each of said collection members for drawing liquid through the collection members and transferring the liquid to the tank, said second means including a first conduit having one end fluidly connected to the first collection member and an opposite end, a second conduit having one end fluidly connected to the second collection member and an opposite end and third means connected to the tank and the first and second conduit opposite ends for selectively fluidly connecting the first and second conduits respectively to the tank.

9. The apparatus of claim 8 further characterized in that said vehicle has means for steering the vehicle to turn the vehicle, that the third means includes a valve housing having spaced first, second and third ports, a valve member in the housing movable between a first position permitting fluid flow from the third to the second port and blocking fluid flow from the third to the first port and a second position permitting fluid flow from the third to the first port and blocking fluid flow from the third to the second port, means operated by the turning of the vehicle from a straight ahead direction of travel in a direction opposite that from which the second collection member is transversely offset from the first collection member for moving the valve member from its second positions to its first position, and a third conduit for fluidly connecting the tank to the third port, said first line opposite end being fluidly connected to the first port and said second line opposite end being fluidly connected to the second port.

10. The apparatus of claim 9 further characterized in that said vehicle comprises a power unit having some of said engaging wheels, a trailer unit having some of said ground engaging wheels and fourth means for towingly connecting the trailer unit to the power unit, said fourth means including a mounting member fixedly attached to the power unit to extend rearwardly thereof, a tow device connected to the trailer unit to extend forwardly thereof and fifth means mounted by the mounting member for pivotal movement about a generally vertical axis for towingly connecting the towing device to the mounting member, said fifth means being attached to the towing device to be translated therewith as the device moves in a plane parallel to the surface and that the steering means comprises power operated means mounted on the power unit and connected to the fifth means for selectively exerting a force on the fifth means to turn the power unit relative the trailer unit about said axis as said vehicle is moving over the surface.

11. The apparatus of claim 10 further characterized in that the means operated by the turning of the vehicle includes an arm fixedly attached to said fifth means and linkage means connecting said arm to the valve member for moving the valve member between its positions as the power unit turns about said axis relative the trailer frame.

12. The apparatus of claim 10 further characterized in that there is provided a scrubber unit, sixth means for mounting the scrubber unit on the front end of the power unit, said scrubber unit including a frame having a downwardly opening enclosure, a power driven rotary brush, means mounting the brush on the scrubber unit frame to extend within said enclosure for rotation about an axis transverse to the normal forward direction of movement of the vehicle and longitudinally elongated side squeegees mounted by the scrubber unit frame to extend along either transverse side thereof and both forwardly and rearwardly of the brush, said squeegee assembly being mounted on the power unit rearwardly of the brush and the side squeegees and extending adjacent to and transversely outwardly beyond the adjacent side squeegee portion.

13. The apparatus of claim 12 further characterized in that the sixth means includes a mounting device attached to the scrubber unit frame, a pivot device for mounting the mounting device and having a predominately vertical pivot axis, and seventh means for mounting the pivot device on the power unit for pivotal movement about the last mentioned pivot axis and that there is provided means connected to the scrubber unit for adjustably retaining the scrubber unit in selected angular positions relative said last mentioned pivot axis.

* * * * *

UNITED STATES PATENT AND TRADEMARK OFFICE

CERTIFICATE OF CORRECTION

PATENT NO. : 3,942,218

DATED : March 9, 1976

INVENTOR(S) : Keith N. Krier et al.

It is certified that error appears in the above-identified patent and that said Letters Patent are hereby corrected as shown below:

Column 6, line 33 "is substantial" should be --is a substantial--; Column 9, line 45, "acrubbing" should be --scrubbing--; Column 15, line 12 "havng" should be --having-- (Amendment: Claim 13, line 2); Column 15, line 19 "mounting attached" should be --mounting member attached-- (Amendment: Claim 13, line 8).

Signed and Sealed this twenty-ninth Day of June 1976

[SEAL]

Attest:

RUTH C. MASON
*Attesting Officer*

C. MARSHALL DANN
*Commissioner of Patents and Trademarks*